United States Patent [19]

Kononov et al.

[11] 4,181,003

[45] Jan. 1, 1980

[54] HYDRAULIC SCREW PRESS DRIVE

[76] Inventors: Ivan V. Kononov, ulitsa Torpedo, 40, kv. 4; Mikhail P. Makushin, ulitsa Oleko Dundicha, 7, kv. 15; Dmitry I. Polukhin, ulitsa Geroev Sibiryakov, 23, kv. 59; Vyacheslav E. Popov, ulitsa Peshestreletskaya, 125, kv. 76; Viktor P. Salov, ulitsa Zhelyabova, 17, kv. 123, all of Voronezh, U.S.S.R.

[21] Appl. No.: 941,592

[22] Filed: Sep. 12, 1978

[51] Int. Cl.[2] ..... B21J 9/16

[52] U.S. Cl. ..... 72/441; 72/453.03; 72/454

[58] Field of Search ..... 72/454, 441, 453.03; 100/270, 289

[56] References Cited

U.S. PATENT DOCUMENTS

| | | | |
|---|---|---|---|
| 1,913,663 | 6/1933 | Ferris | 100/270 |
| 3,512,476 | 5/1970 | Georg | 100/270 |
| 3,654,799 | 4/1972 | Dischler | 72/454 |
| 3,687,070 | 8/1972 | Dischler | 72/454 |

FOREIGN PATENT DOCUMENTS

| | | | |
|---|---|---|---|
| 443708 | 4/1975 | U.S.S.R. | 72/454 |

*Primary Examiner*—Francis S. Husar
*Assistant Examiner*—Gene P. Crosby
*Attorney, Agent, or Firm*—Fleit & Jacobson

[57] ABSTRACT

A drive of a hydraulic screw press comprises a power cylinder incorporating a movable member connected with the press slide. A limit switch actuated by the downward travel of the slide opens a shutoff valve which permits fluid to flow through an adjustable flow-restrictor to actuate the piston of a pneudraulic cylinder within a preset time period determined by the adjustment of the flow restrictor. At the end of the preset time period, the rod of the piston will have traveled a distance sufficient to actuate a limit switch to control a valve arrangement for discharging the pressure in communication with the power cylinder. The slide is returned to the initial upper position by a cylinder under a constant pressure.

2 Claims, 1 Drawing Figure

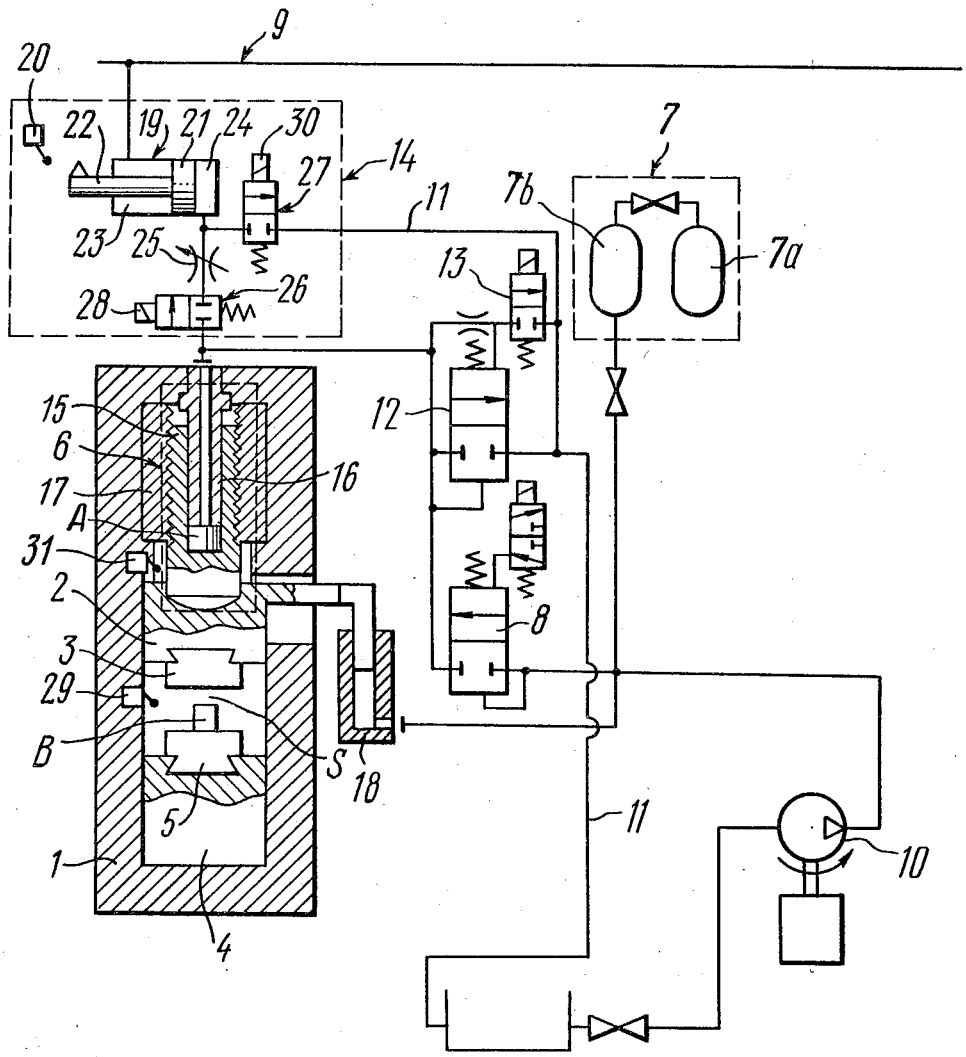
9
20
22
19
21
24
30
27
14
11
7
7b
7a
23
25
26
28
13
12
15
6
16
17
A
31
2
8
3
29
B
S
18
5
1
4
11
10

HYDRAULIC SCREW PRESS DRIVE

The present invention relates to hydraulic screw presses and, more particularly, to the drives thereof.

Known in the prior art are the drives of hydraulic screw presses comprising a power cylinder connected by its movable member with the press slide, the chamber of said cylinder communicating via an inlet valve with a pneudraulic accumulator, said accumulator communicating with a pneumatic line and a source of pressure and, via a discharge valve provided with a control element and its actuating device, with a low-pressure hydraulic line.

The device for actuating the discharge valve in the prior art drives is constituted by a limit switch interacting with the press slide in its downmost position. This limit switch is mounted on the press frame with a provision for adjusting its position in height relative to the downmost position of the press which depends on the height of the pressed part and on the operating time of the discharge valve.

Such a method of actuating the discharge valve calls for readjusting the position of the limit switch when pressing workpieces of different type-sizes. In addition, when the discharge valve is actuated by the above-described method, the time of shaping the blank by the tool varies within a wide range and depends on many factors, such as, say, the operating time of the discharge valve. This rules out the possibility of the tool acting on the blank within a preset time with a preset force and thus impairs the quality of the pressed parts and steps up wear of the tool.

An object of the present invention resides in eliminating the aforesaid disadvantages.

The main object of the present invention resides in ensuring the possibility of stepless adjustment within wide limits of the time of tool action on the blank with a preset force which will reduce considerably the wear of the tool and improve the quality of the pressed products.

In accordance with this and other objects disclosure is made of a drive of a hydraulic screw press comprising a power cylinder connected by its movable member with the press slide, the chamber of said cylinder communicating via an inlet valve with a pneudraulic accumulator, said accumulator communicating with a pneumatic line and a source of pressure and, via a discharge valve provided with a control element and its actuating device, with a low-pressure hydraulic line wherein, according to the invention, the device for actuating the discharge valve comprises a pneudraulic cylinder whose under-piston pneumatic chamber is in constant communication with the pneumatic line, the above-piston hydraulic chamber can communicate alternatively with the power cylinder and the low-pressure hydraulic line, and a limit switch connected with the control element of the discharge valve and installed at the extreme positions of the free end of the pneudraulic cylinder rod, whereat the above-piston hydraulic chamber of said cylinder is in communication with the power cylinder.

Such a technical solution provides for stepless adjustment within wide limits of the time of tool action on the blank with a preset force. Thus the time of tool action on the blank can be greatly reduced at the moment when the kinetic energy accumulated by the slide is fully transferred onto the blank or, if necessary, it becomes possible to hold the tool with its force applied to the blank within a required period which reduces considerably the wear of the tool, rules out warping of the workpiece after pressing and improves its quality. Moreover, such a distribution of forces in the process of part shaping steps up considerably the efficiency of the press.

It is practicable that alternate communication of the hydraulic chamber of the pneudraulic cylinder with the power cylinder and the low-pressure hydraulic line should be effected by the use of an adjustable flow-restrictor and shutoff valves each valve being provided with a control element and one of said valves being installed between the above-piston hydraulic chamber of the pneudraulic cylinder and the low-pressure hydraulic line so that the control element of said valve is connected with the limit switch of the pneudraulic cylinder whereas the other shut-off valve and flow restrictor are installed consecutively between the above-piston hydraulic chamber of the pneudraulic cylinder and the power cylinder in the direction towards the pneudraulic cylinder so that the control element of said second shutoff valve is connected with the press slide by a press-mounted limit switch.

Given below is a detailed description of an embodiment of the present invention with reference to the accompanying drawing which is a schematic longitudinal section of the hydraulic screw press and a hydrokinematic diagram of its drive according to the invention.

The hydraulic screw press comprises a frame 1 accommodating a reciprocating slide 2 which carries the top die 3. Installed under the slide in the frame 1 is a table 4 with the bottom die 5.

Reciprocating motion of the slide 2 is effected in the hydraulic screw press by a drive which comprises a power cylinder 6, a pneudraulic accumulator 7, an inlet valve 8, a pneumatic line 9, a source of pressure 10, a low-pressure hydraulic line 11, a discharge valve 12 with a control element 13 and its actuating device 14.

The movable member of the power cylinder 6, i.e. its barrel 15, is connected with the slide 2 and has a chamber "A" accommodating a hollow plunger 16 which is secured in the press frame 1 and serves as the fixed member of the power cylinder 6. The external cylindrical surface of the barrel 15 of the power cylinder 6 is provided with a non-self-locking screw thread (with the helix angle larger than the angle of friction) which is screwed into a nut 17 secured in the frame 1. The barrel 15 is moved in the nut 17 (during the working stroke of the slide 2) by the pressure of fluid in the chamber "A", said fluid being delivered through the hollow plunger 16 from the pneudraulic accumulator 7.

The pneudraulic accumulator 7 has a pneumatic chamber **7*a* pre-charged by a any known method, and a hydraulic chamber 7*b* communicating with the chamber "A" of the power cylinder through the inlet valve 8 and with the source of pressure 10** which is constituted by a motor-driven H.P. pump. The pump may be of any known design suitable for the purpose.

The chamber "A" of the power cylinder 6 communicates with the low-pressure hydraulic line 11 via the discharge valve 12.

To return the barrel 15 of the power cylinder 6 to the initial position, the drive incorporates a plunger-type cylinder 18 whose plunger is connected with the slide 2, the cylinder 18 being in constant communication with the hydraulic chamber 7*b* of the pneudraulic accumulator 7.

It has already been stated above that the discharge valve 12 is provided with a control element 13 and its actuating device 14, the latter, according to the invention, comprising a pneudraulic cylinder 19 and a limit switch 20 connected by any known method with the control element 13 of the discharge valve 12.

The pneudraulic cylinder 19 has a piston 21 with a rod 22, an under-piston pneumatic chamber 23 and an above-piston hydraulic chamber 24. The under-piston chamber 23 is in constant communication with the pneumatic line 9.

The above-piston hydraulic chamber 24 of the pneudraulic cylinder 19 can be put in communication alternately with the chamber "A" of the power cylinder 6 and the low-pressure hydraulic line 11 through an adjustable flow restrictor 25 and two shutoff valves 26 and 27 of any known type suitable for the given purpose.

The limit switch 20 is installed on the path of the rod 22 of the piston 21 of the pneudraulic cylinder 19 for interaction with the free end of the rod 22 in its extreme position in which the above-piston hydraulic chamber 24 of the pneudraulic cylinder 19 is in communication with the chamber "A" of the power cylinder 6.

The shutoff valve 26 is provided with a control element 28 which is connected by a press-mounted limit switch 29 with the press slide 2 for opening the shutoff valve 26 and by a limit switch 20 with the rod of the pneudraulic cylinder 19 for closing said shutoff valve 26. The connection of the control element 28 with the limit switches 29 and 20 may be of any type, e.g. electrical, and is not dealt with here since it is well known to those skilled in the art. The limit switch 29 is installed on the path of the slide 2 in such a position of the latter when the gap "S" between the top and bottom dies 3 and 5 is equal to the maximum height of the blank.

The shutoff valve 26 and the adjustable flow restrictor 25 are installed between the above-piston hydraulic chamber 24 of the pneudraulic cylinder 19 and the chamber "A" of the power cylinder 6 consecutively in the direction toward the pneudraulic cylinder 19 (as shown in the drawing).

The shut-off valve 27 is provided with a control element 30 and installed between the above-piston hydraulic chamber 24 of the pneudraulic cylinder and the low-pressure hydraulic line 11, the control element 30 of the shutoff valve 27 being connected with the limit switch 20 and the control element 13 of the discharge valve 12 by any known method which makes it possible to actuate the shutoff valve 27 and put the hydraulic chamber of the pneudraulic cylinder 19 in communication with the low-pressure hydraulic line 11.

The control elements 30 and 13 can be disconnected by a limit switch 31 installed on the path traversed by the slide 2 in its motion to the topmost position and connected by any known means with the control elements 30 and 13.

The control elements 28, 30 and 13 as well as the inlet and discharge valves 8 and 12 can be constituted by any mechanisms known to those skilled in the art, provided they are cut into the drive of the hydraulic screw press in compliance with the claimed layout.

The drive of a hydraulic screw press functions as follows.

The pneumatic chamber 7*a* of the pneudraulic accumulator 7 is charged with gas by any known method. Then the motor of the pressure source is turned on and the hydraulic chamber 7*b* of the pneudraulic accumulator 7 is charged with fluid by a known method.

The slide 2 occupies the topmost position while the piston 21 with the rod 22 of the pneudraulic cylinder 19 is in the extreme right position (in the plane of the drawing).

The inlet valve 8 is opened and the fluid starts flowing under pressure from the pneudraulic accumulator 7 through the inlet valve 8 into the chamber "A" of the power cylinder 6. Acted upon by the fluid presure in the chamber "A" and owing to the non-self-locking thread, the barrel 15 of the power cylinder performs a helical motion, moving down onto a blank B located in the gap "S" on the bottom die 5 of the press.

Coming short of the downmost position by the distance equal to the height of the blank "B", the slide 2 interacts with the limit switch 29.

The limit switch 29 sends a signal to the control element 28 and the latter opens the shutoff valve 26. The fluid flows from the chamber "A" of the power cylinder 6 through the shutoff valve 26 and adjustable flow-restrictor 25 into the above-piston hydraulic chamber 24 of the pneudraulic cylinder 19. The piston 21 and the rod 22 move to the left (in the plane of the drawing) within a preset time period which can be adjusted by the flow restrictor 25. Gas is forced out of the under-piston pneumatic chamber 23 of the pneudraulic cylinder 19 into the pneumatic line 9. This motion takes place before the free end of the rod 22 comes in contact with the limit switch 20. Within this time period the slide 2 moves down and shapes the workpiece. On completion of this process and on attaining the required height of the workpiece the slide 2 stops.

As the free end of the rod 22 of the pneudraulic cylinder 19 comes in contact with the limit switch 20, the latter sends a signal to the control element 13 of the discharge valve 12 and to the control element 28 of the shut-off valve 26. The discharge valve 12 opens and puts the chamber "A" of the power cylinder 6 in communication with the low-pressure hydraulic line 11. Pressure in the chamber "A" is relieved.

Simultaneously, the limit switch 20 sends a signal to the control element 30 of the shutoff valve 27 which puts the above-piston chamber 24 of the pneudraulic cylinder 19 in communication with the low-pressure hydraulic line 11.

Acted upon by the pressure of gas entering the under-piston chamber 23 from the pneumatic line 9, the piston 21 with the rod 22 move to the right (in the plane of the drawing), to the initial position.

The slide 2 is returned by the cylinder 18 to the initial topmost position and interacts with the limit switch 31 which turns off the control elements 30 and 13.

During pressing of the next blank the operating cycle of the press is repeated over again as described above.

What we claim is:

1. A drive of a hydraulic screw press comprising: a power cylinder; a movable member of said power cylinder, connected with a press slide; a chamber of said power cylinder; a pneudraulic accumulator incorporating a hydraulic chamber communicating with said chamber of the power cylinder, a source of pressure, and a pneumatic chamber; an inlet valve which puts said chamber of said power cylinder in communication with the hydraulic chamber of said pneudraulic accumulator; a discharge valve through which said chamber of the power cylinder communicates with a low-pressure hydraulic line; a control element of said discharge valve; a device for actuating said discharge valve comprising a pneudraulic cylinder and a piston rod which incorporates an underpiston pneumatic chamber constantly communicating with a pneumatic line, and an above-piston hydraulic chamber which can communicate alternately with said chamber of the power cylinder and said low-pressure hydraulic line; a limit switch of said device for actuating the discharge valve, connected with the control element of the discharge valve and installed in the extreme position of the free end of the pneudraulic piston rod in which its above-piston hydraulic chamber is in communication with the chamber of said power cylinder.

2. A drive according to claim 1 wherein said alternate communication of the above-piston hydraulic chamber of the pneudraulic cylinder with the chamber of the power cylinder or the low pressure hydraulic line is ensured by providing said drive with an adjustable flow testrictor and shuttoff valves with control elements; one of said shut-off valves is installed between the above-piston hydraulic chamber of said pneudraulic cylinder and the low-pressure hydraulic line and its control element is connected with said limit switch while the second one of the two shutoff valves and said adjustable flow restrictor are installed consecutively between the above-piston hydraulic chamber of said pneudraulic cylinder and the chamber of the power cylinder in the direction towards the pneudraulic cylinder so that the control element of this shutoff valve is connected with the press slide; a limit switch installed in said press for connecting the control element of the second one of said shutoff valves with the press slide.

* * * * *